US011319815B2

(12) United States Patent
Eshak et al.

(10) Patent No.: US 11,319,815 B2
(45) Date of Patent: May 3, 2022

(54) MISTUNING OF TURBINE BLADES WITH ONE OR MORE INTERNAL CAVITIES

(71) Applicant: Siemens Energy Global GmbH & Co. KG, Munich (DE)

(72) Inventors: Daniel M. Eshak, Orlando, FL (US); Susanne Kamenzky, Berlin (DE); Daniel Vöhringer, Berlin (DE); Stefan Schmitt, Mülheim an der Ruhr (DE); Heinrich Stüer, Haltern (DE); Yuekun Zhou, Charlotte, NC (US); Samuel R. Miller, Jr., Port St. Lucie, FL (US)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 17/040,222

(22) PCT Filed: Apr. 13, 2018

(86) PCT No.: PCT/US2018/027502
§ 371 (c)(1),
(2) Date: Sep. 22, 2020

(87) PCT Pub. No.: WO2019/199320
PCT Pub. Date: Oct. 17, 2019

(65) Prior Publication Data

US 2021/0010375 A1 Jan. 14, 2021

(51) Int. Cl.
*F01D 5/16* (2006.01)
*F01D 5/18* (2006.01)
*F01D 5/14* (2006.01)

(52) U.S. Cl.
CPC ..... *F01D 5/16* (2013.01); *F01D 5/147* (2013.01); *F01D 5/18* (2013.01); *F01D 5/186* (2013.01);

(Continued)

(58) Field of Classification Search
CPC ... F01D 5/147; F01D 5/16; F01D 1/18; F01D 5/186; F05D 2230/21; F05D 2260/202; F05D 2260/96; F05D 2260/961
See application file for complete search history.

(56) References Cited

U.S. PATENT DOCUMENTS 2,862,686 A * 12/1958 Bartlett ..... F01D 5/16 416/233
2,916,258 A 12/1959 Klint
(Continued)

FOREIGN PATENT DOCUMENTS

EP 2725193 A1 4/2014
EP 2942481 A1 11/2015
(Continued)

OTHER PUBLICATIONS

PCT International Search Report and Written Opinion of International Searching Authority dated Oct. 1, 2018 corresponding to PCT International Application No. PCT/US2018/027502 filed Apr. 13, 2018.

*Primary Examiner* — Ninh H. Nguyen

(57) ABSTRACT

A bladed rotor system includes first and second sets of blades with respective airfoils each having at least one internal cavity. The airfoils of both the first and second sets of blades have identical outer shapes defined by an outer surface of an outer wall of the respective airfoils. The airfoils of the first set of blades are distinguished from the airfoils of the second set of blades by a geometry and/or position of at the least one internal cavity, which is unique to blades of a given set. The natural frequency of a blade of the first set differs from the natural frequency of a blade of the second set by a predetermined amount. The blades of the first set and the second set are alternately arranged in a periodic (Continued)

fashion in said circumferential row, to provide a frequency mistuning to stabilize flutter of the blades.

14 Claims, 3 Drawing Sheets

(52) U.S. Cl.
CPC .... *F05D 2230/21* (2013.01); *F05D 2260/202* (2013.01); *F05D 2260/96* (2013.01); *F05D 2260/961* (2013.01)

(56) References Cited

U.S. PATENT DOCUMENTS

| | | | | |
|---|---|---|---|---|
| 4,097,192 | A | 6/1978 | Kulina | |
| 5,281,084 | A * | 1/1994 | Noe | F01D 5/186 415/115 |
| 6,042,338 | A * | 3/2000 | Brafford | F01D 5/20 416/203 |
| 9,546,552 | B2 * | 1/2017 | Schoenenborn | F01D 5/18 |
| 9,932,840 | B2 * | 4/2018 | Fulayter | F01D 5/146 |
| 2004/0208741 | A1 | 10/2004 | Barb | |
| 2013/0236326 | A1 | 9/2013 | Duong et al. | |
| 2015/0110604 | A1 | 4/2015 | Calza et al. | |

FOREIGN PATENT DOCUMENTS

| | | | |
|---|---|---|---|
| JP | H0861002 | A | 3/1996 |
| JP | 2012117436 | A | 6/2012 |
| JP | 2015520321 | A | 7/2015 |

* cited by examiner

View A-A

View A-A

MISTUNING OF TURBINE BLADES WITH ONE OR MORE INTERNAL CAVITIES

BACKGROUND

1. Field

The present invention relates to rotating blades in a turbomachine, and in particular, to a row of turbine blades with one or more internal cavities having a defined frequency mistuning for improved flutter resistance.

2. Description of the Related Art

Turbomachines, such as gas turbine engines, include multiple stages of flow directing elements along a hot gas path in a turbine section of the gas turbine engine. Each turbine stage comprises a circumferential row of stationary vanes and a circumferential row of rotating blades arranged along an axial direction of the turbine section. Each row of blades may be mounted on a respective rotor disc, with the blades extending radially outward from the rotor disc into the hot gas path. A blade includes an airfoil extending span-wise along the radial direction from a root portion to a tip of the airfoil.

Typical turbine blades at each stage are designed to be identical aerodynamically and mechanically. These identical blades are assembled together into the rotor disc to form a bladed rotor system. During engine operation, the bladed rotor system vibrates in system modes. The blade displacement amplitudes caused by this vibration may be more severe in large blades, such as in low pressure turbine stages. For mechanically and aerodynamically identical blades, the aeroelastic modes are patterns of blade vibration with a constant phase angle between adjacent blades which affects the unsteady flow and aerodynamic work done on the blades. In most cases this serves to damp the vibration of adjacent blades. However, under certain conditions, the aerodynamic damping in some of the modes may become negative, which may cause the blades to vibrate in a self-excited manner, called flutter. When this happens, the vibratory response of the system tends to grow exponentially until the blades either reach a limit cycle or break. Even if the blades achieve a limit cycle, their amplitudes can still be large enough to cause the blades to fail from high cycle fatigue.

Frequency mistuning can cause system modes to be distorted by changing the phase angles of adjacent blades, so that the resulting new, mistuned system modes are stable, i.e., they all have positive aerodynamic damping. It may be desirable in some cases to be able to design blades with a certain amount of defined mistuning. Mistuning may be realized by varying the blade frequencies along the rotor disc in a defined manner. Defined mistuning can be a challenge in cooled turbine blades due to casting variation and core movement during the casting process.

Conventionally, mistuning has been implemented on solid blades by removing material on the blade tip, for example, by grinding, to change the frequency of some blades.

SUMMARY

Briefly, aspects of the present invention are directed to an improved technique for implementing defined mistuning in a row of turbine blades with one or more internal cavities.

According to a first aspect of the invention, a bladed rotor system for a turbomachine is provided, which comprises a circumferential row of blades mounted on a rotor disc. Each blade comprises an airfoil having an outer wall delimiting an airfoil interior. The airfoil interior comprises one or more internal cavities. The row of blades comprises a first set of blades and a second set of blades. The airfoils of both the first and second sets of blades have identical outer shapes defined by an outer surface of the outer wall of the respective airfoils. The airfoils of the first set of blades are distinguished from the airfoils of the second set of blades by a geometry and/or position of at least one internal cavity, which is unique to blades of a given set. Thereby, the natural frequency of a blade of the first set differs from the natural frequency of a blade of the second set by a predetermined amount. Blades of the first set and the second set are alternately arranged in a periodic fashion in said circumferential row, to provide a frequency mistuning to stabilize flutter of the blades.

According to a second aspect of the invention a method is provided for producing a bladed rotor system. The method comprises forming a plurality of blades, each blade being formed, at least partially, by a casting process. Each blade comprises an airfoil having one or more internal cavities produced by respective core elements during the casting process. The plurality of blades includes a first set of blades and a second set of blades. The airfoils of both the first and second sets of blades have identical outer shapes defined by an outer surface of the outer wall of the respective airfoils. The casting process for forming the first set of blades differs from the casting process for forming the second set of blades, in that, the respective core element for producing at least one internal cavity has a different geometry and/or position during casting of a blade belonging to the first set, in relation to a blade belong to the second set. The geometry and/or position of the respective core element is kept substantially identical for forming blades of a given set. Thereby, the natural frequency of a blade of the first set differs from the natural frequency of a blade of the second set by a predetermined amount.

BRIEF DESCRIPTION OF THE DRAWINGS

The invention is shown in more detail by help of figures. The figures show preferred configurations and do not limit the scope of the invention.

DETAILED DESCRIPTION

In the following detailed description of the preferred embodiments, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

Figure 1:
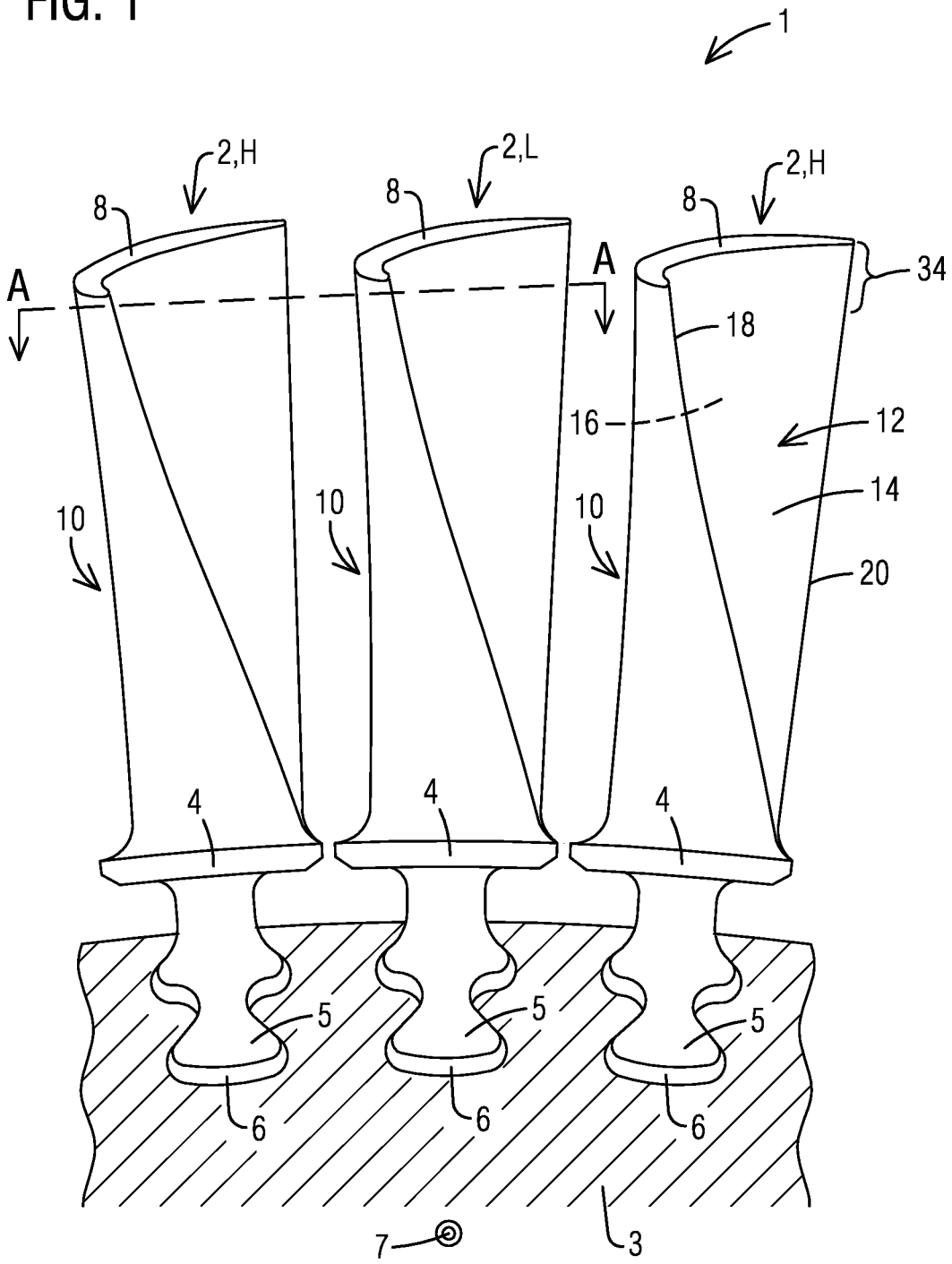
FIG. 1 schematically illustrates, in axial view, a portion of a bladed rotor system having mistuned blades according to an example arrangement.

Referring now FIG. 1, a portion of a bladed rotor system 1 for a turbomachine is illustrated. The bladed rotor system 1 includes a circumferential row of blades 2 mounted on a rotor disc 3. Each blade 2 comprises an airfoil 10 extending span-wise along a radial direction from a platform 4 to an airfoil tip 8. An airfoil 10 may comprise an outer wall 12 having a generally concave pressure side 14 and a generally convex suction side 16, which are joined at a leading edge 18 and at a trailing edge 20. Each blade 2 may be mounted on the disc 3 via an attachment structure 5, referred to as a root, which extends radially inward from the platform 4. The root 5 may have a fir-tree shape, which fits into a correspondingly shaped slot 6 in the rotor disc 3. In the context of the illustrated embodiments, it may be assumed that each blade 2 of the blade row has essentially identical fir-tree attachments. The platforms 4 of adjacent blades 2 align circumferentially, whereby the radially outer surfaces of neighboring platforms 4 form an inner diameter flow path boundary for a working fluid of the turbomachine. In the described embodiments, the blades 2 are cooled turbine blades, wherein each airfoil 10 may have one or more cooling passages formed by internal cavities 22, 24, 26 (see FIGS. 2 and 3) for conducting a cooling fluid between the root 5 and the tip 8. It should however be recognized that aspects of the present invention may be applied to uncooled hollow blades comprising one or more internal cavities.

The airfoils 10 extend radially outward into the flow path and extract energy from the working fluid, which causes the blades 2 to rotate about a rotation axis 7. As the airfoils 10 extract energy from the working fluid, the working fluid exerts a loading force on the airfoils 10. Variations in the loading force cause the blades 2 to deflect and vibrate. This vibration has a broad spectrum of frequency components, with the greatest amplitude at the natural resonant frequency of the blades 2. The vibration may have components in the tangential and axial directions.

Figure 2:
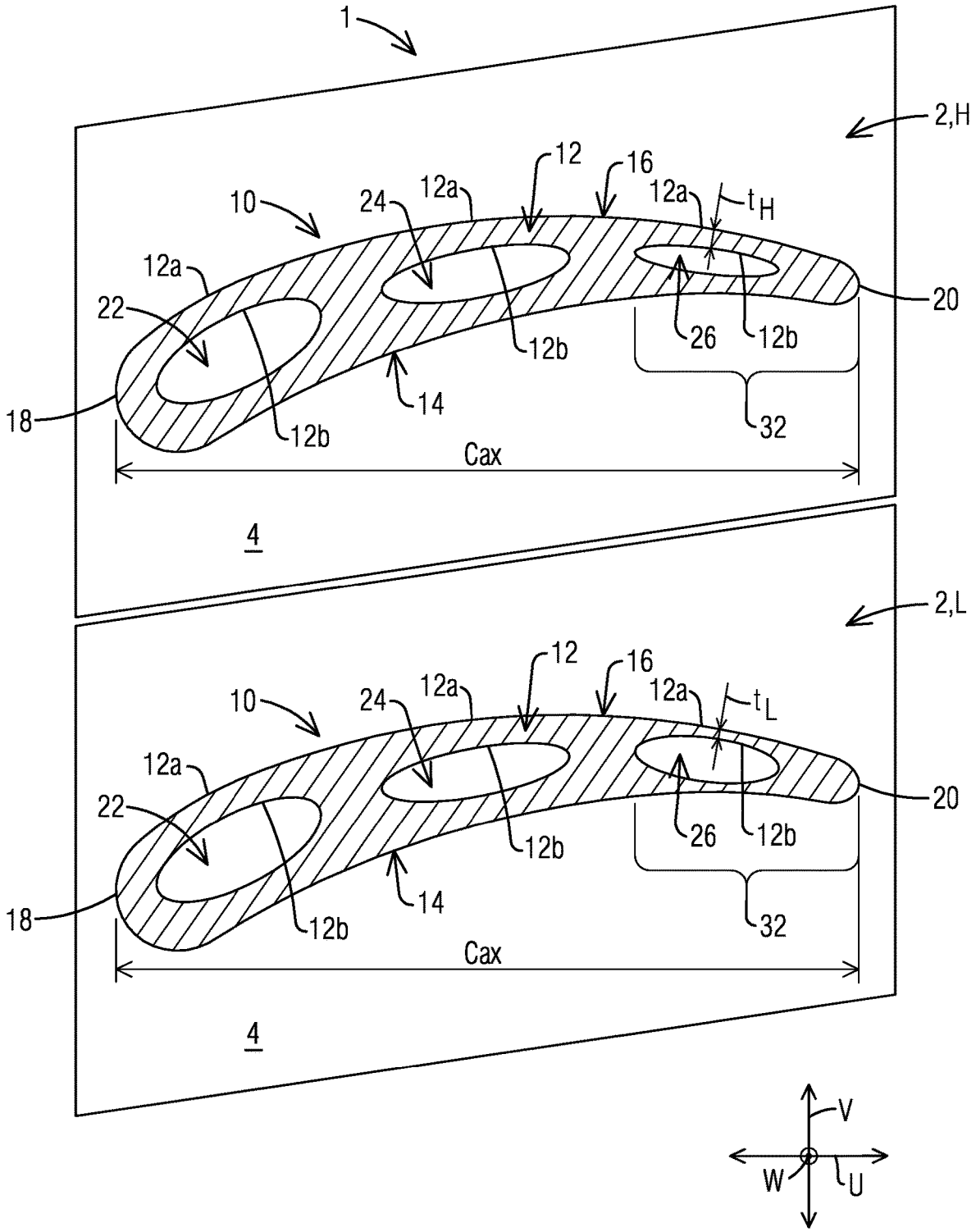
FIG. 2 is a cross-sectional view of a bladed rotor system, illustrating a pair of mistuned blades according to a first embodiment of the invention.
Figure 3:
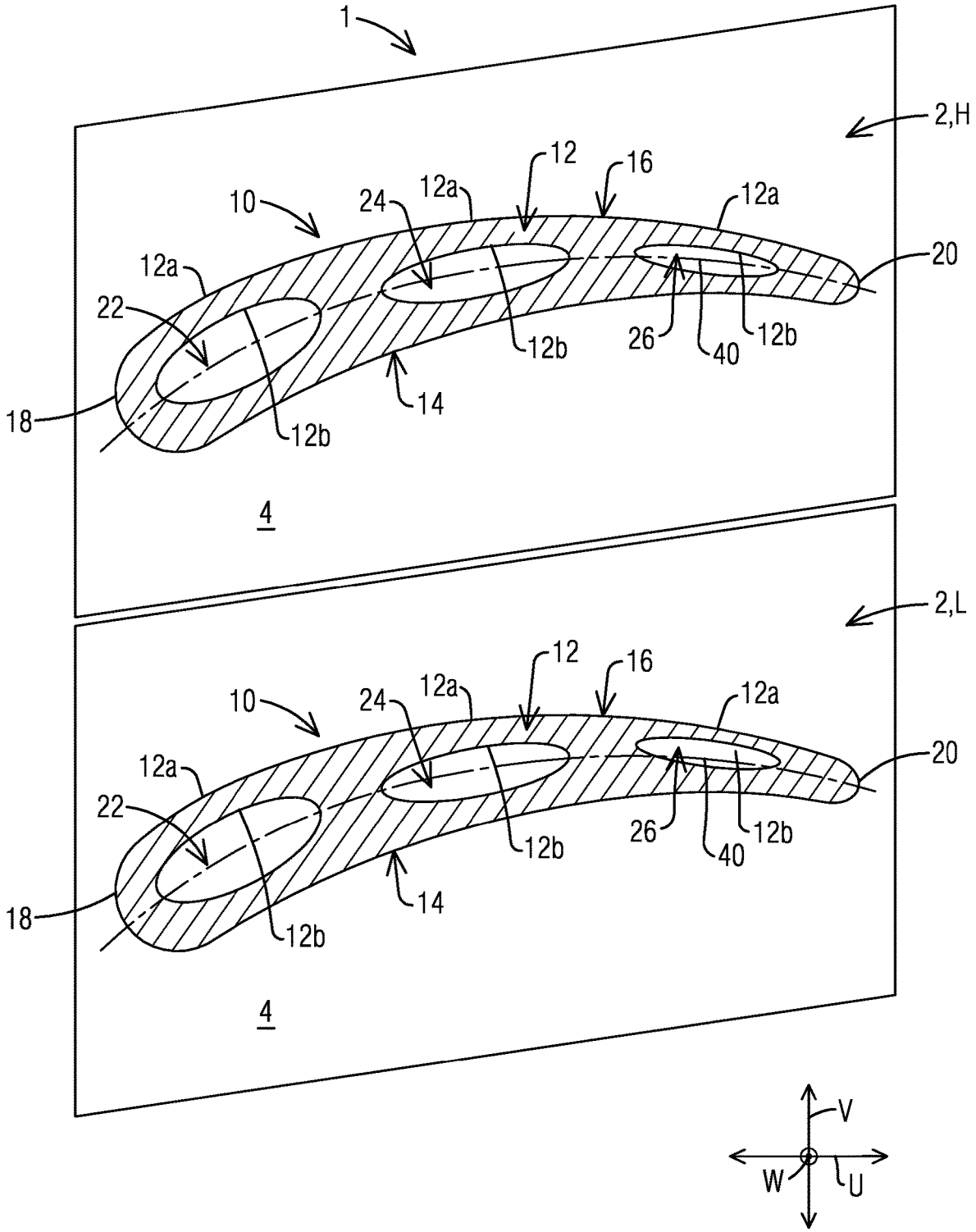
FIG. 3 is a cross-sectional view of a bladed rotor system, illustrating a pair of mistuned blades according to a second embodiment of the invention.

An underlying idea of the illustrated embodiments involves designing the bladed rotor system 1 to have alternate mistuning of blade frequencies by modifying an internal geometry while keeping the external shape of the airfoils 10 uniform. In the illustrated examples, the bladed rotor system 1 is comprises two sets of blades 2, namely a first of blades 2 denoted by H, and a second set of blades 2 denoted by L. The airfoils 10 of both sets of blades H and L have identical outer shapes. The outer shape may be defined by a three-dimensional shape of the outer surface 12*a* of the respective airfoil outer wall 12 (see FIGS. 2 and 3). The airfoils 10 belonging to the first set H may be distinguished from the airfoils 10 belonging to the second set L by a geometry of at least one internal cavity 26, which is unique to blades of a given set, as shown in FIG. 2. Alternately or additionally, the airfoils 10 belonging to the first set H may be distinguished from the airfoils 10 belonging to the second set L by a position of at least one internal cavity 26, which is unique to blades of a given set, as shown in FIG. 3. On account of the resultant differences in mass and/or stiffness between the blades of the two sets H and L, the natural frequency of a blade 2 of the first set H differs from the natural frequency of a blade 2 of the second set L by a predetermined amount. The blades of the first set H are therefore frequency mistuned in relation to blades of the second set L. A feature of the illustrated embodiments is that the external geometry of the airfoils 10 which extend into the flow path is essentially identical throughout the bladed rotor system 1, whereby frequency mistuning may be implemented without impacting the aerodynamic efficiency of the system 1.

To implement a defined mistuning to mitigate flutter of the blades 2, the blades of the first set H and the second set L may be alternately mounted around the rotor disc 3 in a periodic fashion, as shown in FIG. 1. The term "alternately" may refer to every other blade, or refer to a continuous group of blades with similar vibratory characteristics. In the illustrated embodiment, the blades 2 of the first set H and the second set L alternate individually (one after the other) in a circumferential direction, in a pattern HLH. In further embodiments groups of two or more blades of the first set H and the second set L may alternate in a periodic fashion along the circumferential direction in the blade row, for example in patterns including HHLLHH, HHHLLHHH, HHHLLLHHH, and so on.

In one embodiment, as illustrated herein, a bladed rotor system in accordance with the present inventive concepts may be formed, at least partially, by a casting process. In other embodiments, such a bladed rotor may be formed by other manufacturing methods, including but not limited to additive manufacturing processes.

Example embodiments of the present invention are now described referring to FIG. 2 and FIG. 3. In FIGS. 2 and 3, the axes u, v and w respectively denote an axial direction, a circumferential direction and a radial direction, the radial direction being perpendicular to the plane of the drawings.

Referring to FIG. 2, a first example embodiment of the invention is illustrated. The drawing depicts two blades 2 in cross-sectional view, which respectively belong to the first set H and the second set L. As shown, each of the blades 2 has a respective airfoil 10 with an outer wall 12 which extends span-wise along the radial direction. The outer wall 12 delimits an airfoil interior, which is generally hollow. The interior of the airfoil 10 comprises one or more internal cavities, which in the present embodiment are configured as cooling passages. In this example, three internal cavities or cooling passages are provided, namely a leading edge cooling passage 22 positioned adjacent to the leading edge 18, a trailing edge cooling passage 26 positioned adjacent to the trailing edge 20, and a mid-chord cooling passage 24 positioned between the leading edge cooling passage 22 and the trailing edge cooling passage 26. The cavities 22, 24, 26 extend-span-wise and are configured to conduct a cooling fluid radially between the root 5 and tip 8 of the respective airfoil 10 during operation (see FIG. 1). The outer wall 12 has an outer surface 12*a* that faces the hot working fluid during operation and an inner surface 12*b* facing the internal cavities 22, 24, 26.

In one embodiment, the blades 10 may be manufactured by a casting process, such as an investment casting process, the basic principle of which is known to one skilled in the art and will not be further described. During casting, the internal cavities in the blades 2, such as the cavities 22, 24 and 26 are produced by a respective core element, which is subsequently removed after the casting process to produce these cavities. The final geometry of the internal cavities 22, 24, 26 thereby correspond to the geometry of the respective core elements. The casting process may sometimes be followed by an outer machining process to arrive at a final outer shape of the airfoil 10 as defined by the outer surface 12*a* of the outer wall 12. The outer shapes of the airfoils 10 of the first set H may be substantially identical to that of the airfoils 10 of the second set L, i.e., subject to standard manufacturing tolerances.

According to the present embodiment, the airfoils 10 belonging to the first set H are distinguished from the airfoils 10 belonging to the second set L by a geometry of one or more of the internal cavities 22, 24, 26, said geometry being unique for a given set H or L. In one embodiment, as shown, the geometry of only one of the internal cavities 26 is different for airfoils 10 belonging to the first set H, in relation to that of airfoils 10 belonging to the second set L.

In this case, the geometries of the internal cavities 22 and 24 of the airfoils 10 of the first set H are substantially identical to the corresponding geometries of the internal cavities 22 and 24 of the airfoils 10 of the second set L, subject to manufacturing tolerances. The casting process for producing the blades 2 of the first set H and the blades 2 of the second set L are thereby different, in that they involve the use of different core geometries for producing at least one of the internal cavities. In this case, the respective core element for producing at least one internal cavity 26 during casting has a different geometry for blades 2 of the first set H, in relation to blades 2 of the second set L. The geometry of the respective core element for producing the internal cavity 26 is substantially identical for blades belonging to a given set H or L.

On account of the variation of casting core geometry, the airfoils 10 belonging to the first set H may have a different outer wall thickness or thickness distribution than that of the airfoils 10 belonging to the second set L. The outer wall thickness, as measured at a given point on the outer surface 12*a* of the outer wall 12 of the airfoil 10, may be defined as the shortest distance from said point on the outer surface 12*a* to any point on the inner surface 12*b* of the outer wall 12. The outer wall thickness may be uniform for all points on the outer surface 12*a* of the outer wall 12, or may vary along a span-wise and/or chord-wise extent of the outer wall 12. In the example shown in FIG. 2, an outer wall thickness $t_H$ of the airfoils 10 belonging to the first set H is different from (in this case, greater than) an outer wall thickness $t_L$ of the airfoils 10 belonging to the second set L measured at a corresponding point on the outer wall 12, for at least a portion of the outer wall 12 of the respective airfoils 10. The blades 2 of the first set H thereby have higher mass and stiffness in relation to the blades 2 of the second set L, such that the natural frequency of the blades 2 of the first set H is higher than that of the blades 2 of the second set L. The differences in outer wall thickness may be predetermined based on a defined variation in core geometries to obtain a desired frequency mistuning (e.g., 2-5% frequency mistuning) to stabilize flutter of blades during operation.

In the embodiment illustrated in FIG. 2, the difference in outer wall thickness between the airfoils of the two sets H, L is provided for a portion of the outer wall 12 which is limited only to a trailing edge region 32 of the respective airfoils 10. The trailing edge region 32 may be defined as a region of the outer wall 12 which is adjacent to the trailing edge 20, and extends from the trailing edge to an intermediate location between the leading edge 18 and the trailing edge 20, along the pressure side 14 and the suction side 16. In a non-limiting example, the trailing edge region 32 may extend up to 30% of an axial chord length Cax from the trailing edge 20. To this end, as shown in FIG. 2, the casting core variation between the first and second sets of blades H and L may be applied only for the trailing edge cooling passage 26. In a further embodiment, the difference in outer wall thickness between the blades of sets H and L may be provided only for a tip portion (for example, up to 20% span from the airfoil tip 8) extending chord-wise along entire periphery of the of the airfoil from the leading edge 18 to the trailing edge 20 or a portion thereof. In the illustrated embodiment, the difference in outer wall thickness between the blades of sets H and L may be provided only for a tip portion 34 of the trailing edge region 32. As mentioned, the tip portion 34 may, for example, have a span-wise extent less than or equal to 20% of the span of the airfoil 10 from the airfoil tip 8 (see FIG. 1).

The above-described embodiments are based on the recognition that the stiffness of the blades 2 may be impacted more by modifying a geometry at the trailing edge and tip portions of the airfoils 10 in relation to other locations. By limiting casting core variations to these specific locations, it may be possible to achieve a desired frequency mistuning with minimum variation in mass between the mistuned blades. In other embodiments, the difference in outer wall thickness may be provided along the entire extent of the outer wall 12, or to other portions having different chord-wise and/or span-wise extents than that illustrated above.

In one embodiment, the difference between the outer wall thickness $t_H$ of the airfoils 10 belonging to the first set H and the corresponding outer wall thickness $t_L$ of the airfoils 10 belonging to the second set L is not constant but varies along chord-wise and/or span-wise directions within the designated portion mentioned above. In an exemplary embodiment, a maximum difference between the outer wall thickness 44 of the airfoils 10 belonging to the first set H and the corresponding outer wall thickness $t_L$ of the airfoils 10 belonging to the second set L is equal to or less than 20% of a corresponding nominal outer wall thickness of the airfoils 10.

Referring to FIG. 3, a second example embodiment of the invention is illustrated. The description of like elements will not be repeated for the sake of simplicity. The drawing depicts two blades 2 in cross-sectional view, which respectively belong to the first set H and the second set L. The outer shapes of the airfoils 10 of the first set H may be substantially identical to that of the airfoils 10 of the second set L, i.e., subject to standard manufacturing tolerances.

According to the present embodiment, the airfoils 10 of the first set H are distinguished from the airfoils 10 of the second set L by a position of one or more of the internal cavities 22, 24, 26, said position being unique to blades 2 of a given set H or L. In one embodiment, as shown, the position of only one of the internal cavities 26 is different for airfoils 10 belonging to the first set H, in relation to that of airfoils 10 belonging to the second set L. In this case, the positions of the internal cavities 22 and 24 of the airfoils 10 belonging to the first set H are substantially identical to the corresponding positions of the internal cavities 22 and 24 of the airfoils 10 belonging to the second set L, subject to casting tolerances. The casting process for producing the blades 2 of the first set H and the blades 2 of the second set L are thereby different, in that they involve different core positions for producing at least one of the internal cavities. In this case, the respective core element for producing at least one internal cavity 26 has a different position during casting in case of the blades 2 of the first set H, in relation to blades 2 of the second set L. The position of the respective core element for producing the internal cavity 26 may be substantially identical for blades of a given set H or L.

In the example shown in FIG. 3, the internal cavity 26 of an airfoil 10 of the first set H is centered about an airfoil camber line 40. The internal cavity 26 of an airfoil 10 of the second set L may be offset from the camber line 40 toward the pressure side 14 or the suction side 16 (in this case, toward the suction side 16). The above may be achieved by applying a defined offset between the position of the core element forming the internal cavity 26 of an airfoil 10 of the first set H and the corresponding core element forming the internal cavity 26 of an airfoil 10 of the second set L.

In one embodiment, the geometries of each of the internal cavities 22, 24, 26 of an airfoil 10 of the first set H (and the respective core elements for producing them) may be substantially identical to the geometries of the corresponding internal cavities 22, 24, 26 of an airfoil 10 of the second set L (and the respective core elements for producing them). In such a case, it may be possible to provide a desired frequency mistuning based on a defined variation in core position, resulting in different blade stiffnesses but with essentially no variation in mass between the mistuned blades. As illustrated herein, a required difference in blade stiffness may be achieved by limiting the variation in core position to only the trailing edge cooling passage 26. In various embodiments, a variation in core position may be applied for any one or more or all of the internal cavities 22, 24 and 26.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

The invention claimed is:

1. A bladed rotor system for a turbomachine, comprising:

a circumferential row of blades mounted on a rotor disc, each blade comprising an airfoil having an outer wall delimiting an airfoil interior, the airfoil interior comprising one or more internal cavities, the row of blades comprising a first set of blades and a second set of blades, wherein:

the airfoils of both the first and second sets of blades have identical outer shapes defined by an outer surface of the outer wall of the respective airfoils, and the airfoils of the first set of blades are distinguished from the airfoils of the second set of blades by a geometry and/or position of at least one internal cavity, which is unique to blades of a given set, whereby the natural frequency of a blade of the first set differs from the natural frequency of a blade of the second set by a predetermined amount, and wherein blades of the first set and the second set are alternately arranged in a periodic fashion in said circumferential row, to provide a frequency mistuning to stabilize flutter of the blades, wherein an outer wall thickness of the airfoils belonging to the first set differs from a corresponding outer wall thickness of the airfoils belonging to the second set, for at least a portion of the outer wall of the respective airfoils, and wherein a maximum difference between the outer wall thickness of the airfoils belonging to the first set and the corresponding outer wall thickness of the airfoils belonging to the second set is equal to or less than 20% of a corresponding nominal outer wall thickness.

2. The bladed rotor system according to claim 1, wherein said portion is limited only to a trailing edge region of the respective airfoils.

3. The bladed rotor system according to claim 2, wherein said portion is further limited only to a tip portion extending up to 20% span from a tip of the respective airfoils.

4. The bladed rotor system according to claim 1, wherein the difference between the outer wall thickness of the airfoils belonging to the first set and the corresponding outer wall thickness of the airfoils belonging to the second set varies chord-wise and/or span-wise within said portion.

5. The bladed rotor system according to claim 1, wherein a first position of the at least one internal cavity of the airfoils belonging to the first set differs from a second position of the corresponding at least one internal cavity of the airfoils belonging to the second set, the second position being offset from the first position toward a pressure side or a suction side of the respective airfoils.

6. The bladed rotor system according to claim 5, wherein each of the one or more internal cavities of the airfoils belonging to the first set has a substantially identical geometry in relation to a corresponding internal cavity of the airfoils belonging to the second set.

7. The bladed rotor system according to claim 1, wherein said at least one internal cavity is a trailing edge cooling passage.

8. A method for producing a bladed rotor system, comprising:

forming a plurality of blades, each blade being formed at least partially by a casting process, each blade comprising an airfoil having one or more internal cavities produced by respective core elements during the casting process, wherein:

the plurality of blades includes a first set of blades and a second set of blades, the airfoils of both the first and second sets of blades have identical outer shapes defined by an outer surface of the outer wall of the respective airfoils, and the casting process for forming the first set of blades differs from the casting process for forming the second set of blades, in that, the respective core element for producing at least one internal cavity has a different geometry and/or position during casting of a blade belonging to the first set in relation to a blade belonging to the second set, the geometry and/or position of the respective core element being kept substantially identical for forming blades of a given set, whereby the natural frequency of a blade of the first set differs from the natural frequency of a blade of the second set by a predetermined amount, wherein during casting, a first position of the respective core element for producing the at least one internal cavity of the airfoils belonging to the first set differs from a second position of the respective core element for producing the corresponding at least one internal cavity of the airfoils belonging to the second set, the second position being offset from the first position toward a pressure side or a suction side of the respective airfoils, and wherein the respective core elements for producing each of the one or more internal cavities of the airfoils belonging to the first set has a substantially identical geometry in relation to the respective core element for producing a corresponding internal cavity of the airfoils belonging to the second set.

9. The method according to claim 8, comprising mounting the blades circumferentially around a rotor disc, such that blades of the first set and the second set alternate in a periodic fashion.

10. The method according to claim 8, wherein said respective core elements are designed such that an outer wall thickness of the airfoils belonging to the first set differs from a corresponding outer wall thickness of the airfoils belonging to the second set, for at least a portion of the outer wall of the respective airfoils.

11. The method according to claim 10, wherein said portion is limited only to a trailing edge region of the respective airfoils.

12. The method according to claim 11, wherein said portion is further limited only to a tip portion extending up to 20% span from a tip of the respective airfoils.

13. The method according to claim 10, wherein said respective core elements are designed such that the difference between the outer wall thickness of the airfoils belonging to the first set and the corresponding outer wall thickness of the airfoils belonging to the second set varies chord-wise and/or span-wise within said portion.

14. The method according to claim 8, wherein said at least one internal cavity is a trailing edge cooling passage.

* * * * *